US007804029B1

(12) United States Patent
Tremblay et al.

(10) Patent No.: US 7,804,029 B1
(45) Date of Patent: Sep. 28, 2010

(54) ELECTROMAGNETIC WRAP

(75) Inventors: Paul L Tremblay, Idaho Falls, ID (US); Jill R Scott, Idaho Falls, ID (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 175 days.

(21) Appl. No.: 12/329,141

(22) Filed: Dec. 5, 2008

(51) Int. Cl.
*H01B 7/00* (2006.01)

(52) U.S. Cl. ..... 174/117 R; 174/117 F; 174/117 FF

(58) Field of Classification Search ..... 174/28, 174/102 R, 105 R, 106 R, 110 R, 117 F, 117 FF, 174/120 R
See application file for complete search history.

(56) References Cited

U.S. PATENT DOCUMENTS

| | | | | |
|---|---|---|---|---|
| 4,751,514 | A * | 6/1988 | Sheriff | 343/717 |
| 5,426,399 | A * | 6/1995 | Matsubayashi et al. | 333/1 |
| 6,812,408 | B2 * | 11/2004 | Clark et al. | 174/113 R |
| 6,825,419 | B2 * | 11/2004 | Grogl et al. | 174/112 |
| 7,196,273 | B2 * | 3/2007 | Tanaka et al. | 174/117 R |
| 2008/0093113 | A1 * | 4/2008 | Jow et al. | 174/260 |

* cited by examiner

*Primary Examiner*—William H Mayo, III
(74) *Attorney, Agent, or Firm*—Michael J. Dobbs; Daniel D. Park

(57) ABSTRACT

A device and method for altering the line reactance of a transmission line having a transmission line, a first floating conductor and a grounding (shielding) conductor. The first floating conductor is positioned between and electrically insulated from the transmission line and the grounding conductor. A source and a load are connected at opposite ends of the transmission line.

16 Claims, 11 Drawing Sheets

ELECTROMAGNETIC WRAP

GOVERNMENT INTERESTS

The United States Government has rights in this invention pursuant to Contract No. DE-AC07-05ID14517, between the U.S. Department of Energy (DOE) and the Battelle Energy Alliance.

FIELD OF THE INVENTION

An electromagnetic wrap device and method for the control of transmission line reactances (combination of capacitance, inductance, and resistivity).

BACKGROUND OF THE INVENTION

Transmission lines are used in a myriad of applications from within small handheld electronics transferring communication signals to large power systems transferring large amounts of power. In its simplest form, a transmission line is merely a conductor of electricity from one point (a source) to another (load). Transmission lines may be used for alternating current or direct current where deleterious alternating current surges differing from the fundamental frequency generated by the source may be induced to exist. The elements of the transmission line that allow development of such deleterious surges are the inductance, capacitance, and resistance inherent in the physical characteristics of the transmission line. These physical characteristics allow modes of the frequency components in the surges to induce reactances whose vector sums with the resistance of the transmission line result in an impedance upon which the voltage and current surges are developed. Voltage surges can break down insulation in the system, incapacitating a system by creating electrical shorts. Current surges also incapacitate a system by destroying control elements; switches, fuses, transistors, diodes, etc.

Ideally, transmission lines transfer signals without loss and without alteration of signal information content. If the transmission line characteristics are not optimized for the system, the received signals may be significantly altered, even over relatively short distances. Worse, even when, the transmission line characteristics are optimized, they may allow damaging resonances to form within the transmission line resulting in the aforementioned surges of line current and/or voltage.

For example, the Fourier Transform Ion Cyclotron Resonance Mass Spectrometer (FTMS) at INL (Idaho National Laboratory) uses a coaxial style of transmission line to carry swept high-frequency power (50 Hz to 4 MHz) to metal plates of an ion cyclotron resonance (ICR) cell within a high vacuum and within the strong (7-Tesla) field of a superconducting magnet. This transmission line is severely constrained by two phenomena. First, if the transmission line has too little line capacitance (less than 60 pf), damaging resonances can occur at high frequencies within the transmission line resulting in reflected voltage surges which can puncture the metal-oxide-semiconductor gate structures of FETs (field-effect-transistors) used in the FTMS. Second, if the transmission line has too much capacitance (greater than 100 pf), the current demanded by the combined transmission line and load capacitance exceeds the current limit of the FETs resulting in their destruction.

Another example is the use of stepper motors to control the position of weldments and/or welding torches in a remote, high radiation field, automated process such as that designed for use in Yucca Mountain. State-of-the-art welding systems cannot currently extend beyond approximately 100 feet from their controllers due to the build-up of damaging resonances resulting in the breakdown of insulation in the motors and transmission lines. The need to maintain and operate the controllers in a minimal radiation field for protection of their operators begs for a solution to allow extending the cable length.

Various methods are used to adjust the line reactance (combination of capacitance, inductance, and resistivity) of a transmission line. Obviously, the length or diameter of the wire or the type of insulating material used in a transmission line may be altered to adjust capacitance of the transmission line. Unfortunately, in many instances, these may not be readily changeable or may already be optimized.

Various components may also be added to a transmission line such as capacitors and/or inductors to form filters which seek to control the allowable modes of the frequency components thereby minimizing potential surges. Unfortunately, when capacitors or inductors are used, they act as voltage dividers reducing the voltage transmitted through the transmission line.

Therefore, there exists a need for a device and method for altering the effects of reactive components of a transmission line without substantially altering the transmission line's physical characteristics or reducing the strength of the signal transmitted.

SUMMARY OF THE INVENTION

An electromagnetic wrap device and method for altering the line reactance of a transmission line having a transmission line, a first floating conductor and a grounding conductor. The first floating conductor is positioned at least partially between and electrically insulated from the transmission line and the grounding conductor. A source and a load are connected at opposite ends of the transmission line.

DETAILED DESCRIPTION OF THE INVENTION

An electromagnetic wrap device and method for altering the line reactance (combination of capacitance, inductance, and resistivity) of a transmission line having a transmission line, a first floating conductor and a grounding conductor. The first floating conductor is positioned at least partially between and electrically insulated from the transmission line and the grounding conductor. A source and a load are connected at opposite ends of the transmission line.

FIG. 1

Figure 1:
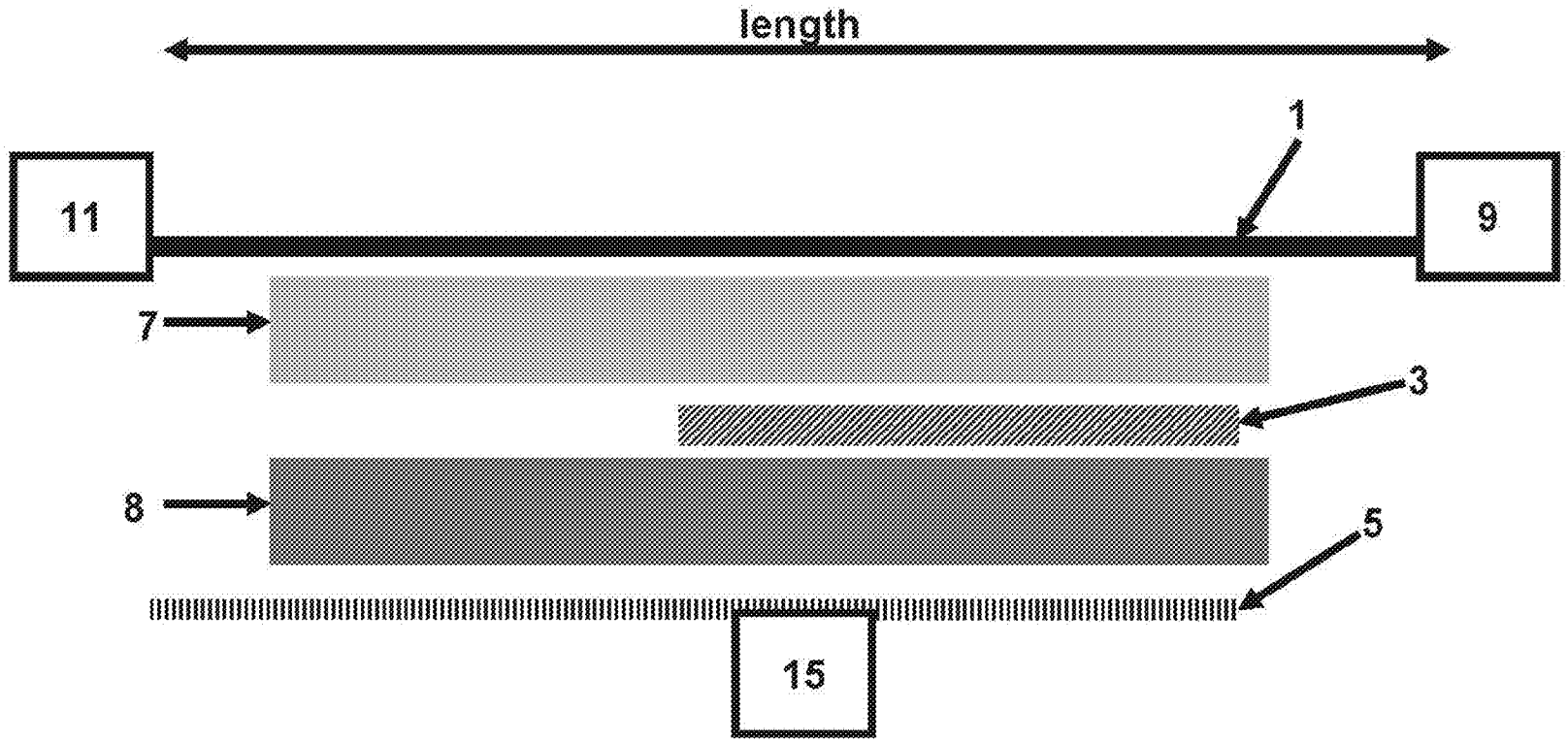
FIG. 1 depicts a longitudinal cross section view of one embodiment of an electromagnetic wrap having a transmission line, a first floating conductor and a grounding conductor.

FIG. 1 depicts a longitudinal cross section view of one embodiment of an electromagnetic wrap having a transmission line 1, a first floating conductor 3, and a grounding conductor 5. The first floating conductor 3 is positioned between the transmission line 1 and the grounding conductor 5. In the embodiment shown in FIG. 1 the first floating conductor 3 runs at least partially along the length of the transmission line 1. A first insulator 7 electrically insulates the transmission line 1 from the first floating conductor 3. Likewise, a second insulator 8 electrically insulates the first floating conductor 3 from the grounding conductor 5.

The transmission line 1 is electrically connected to a first node 9 and a second node 11 at opposite ends. The first node 9 and a second node 11 preferably represent a source and a load, respectively. The grounding conductor 5 is electrically connected to earth-ground 15.

The transmission line 1 line reactance can be adjusted by adjusting the properties (material, shape, dimensions, etc.) of the transmission line 1, first floating conductor 3, grounding conductor 5, the first insulator 7, the second insulator 8, or a combination thereof.

Transmission Line 1

The transmission line 1 transmits an electrical signal between the first node 9 and the second node 11. Preferably, the transmission line 1 is an electrically conductive wire, pipe or any other electrical conductor. Although only one transmission line 1 is depicted in FIG. 1, any number of transmission lines may be used having various shapes and sizes. Preferably, the transmission line 1 is selected to optimize its line reactance while also accounting for the size and weight of the entire system.

First Floating Conductor 3

The first floating conductor 3 is electrically floating and therefore is electrically isolated from voltage sources and drains (contrary to a coaxial cable or a faraday cage). Preferably, the first floating conductor 3 is selected to optimize the line reactance of the transmission line 1 while also accounting for the size and weight of the entire system. Preferably, the first floating conductor 3 is never electrically connected to earth-ground 15. In the alternative, the first floating conductor 3 is selectively electrically connected to earth-ground 15, whereby the transmission line 1 line reactance can be dynamically modified by grounding or floating the first floating conductor 3.

Preferably the first floating conductor 3 surrounds the transmission line 1 along the entire length of the transmission line 1. Although only one first floating conductor 3 is depicted in FIG. 1, any number of first floating conductors 3 may be used having various shapes, sizes, and electromagnetic characteristics. In the embodiment shown in FIG. 1, the first floating conductor 3 is at least partially positioned between the transmission line 1 and the grounding conductor 5. In one alternative embodiment, various reactive or active components are added to the first floating conductor 3 for line optimization, as well as adding optimized filtering characteristics for the transmission line 1. For example, capacitors and inductors may be implemented as shown in FIG. 8*a* and FIG. 9*a*. Other electrical components may also be added to the first floating conductor 3 to build more complex circuits such as transistors, resistors, capacitors, inductors, integrated circuits, etc.

Grounding Conductor 5

The grounding conductor 5 is electrically connected to earth-ground 15. Any circuit will directly or indirectly be connected to earth-ground 15 through various surrounding electrically conductive or electrically insulating materials (e.g., shielding, casing, grounding circuits, air, wood, plastics, etc.) via capacitive coupling. The grounding conductor 5 is depicted in FIG. 1 merely to show a complete circuit for the line reactance of the transmission line 1.

Preferably, the grounding conductor 5 is an outer casing connected to earth-ground 15 in order to reduce noise internal or external to the casing. Although only one grounding conductor 5 is depicted in FIG. 1, any number of grounding conductors 5 may be used having various shapes and sizes. Preferably, the grounding conductor 5 is selected to optimize the line reactance of the transmission line 1 while also accounting for the size and weight of the entire system.

Preferably, the grounding conductor 5 is connected to earth-ground 15 at only one location along the length of the grounding conductor 5 to avoid compromising the integrity of the shielding through a phenomenon known as a ground loop.

Earth-Ground 15

The earth-ground 15 is an electrical ground, preferably earth. Preferably, earth-ground 15 is obtained through the various surrounding electrically conductive or electrically insulating materials (e.g., wires, casing, grounding circuits, air, wood, plastics, etc.) eventually electrically connected to the ground. More preferably, earth-ground 15 is an electrical conductor buried underground (e.g., pipes, wires, etc.).

First Insulator 7 and Second Insulator 8

The first insulator 7 electrically insulates the first floating conductor 3 from the transmission line 1. The second insulator 8 electrically insulates the first floating conductor 3 and the grounding conductor 5. Preferably, the first insulator 7 and the second insulator 8 are each made of air, ceramics, glass, porcelain, composite, polymer materials, polyethylene, PVC, polymers, oil impregnated paper, Teflon®, silicone, modified ethylene tetrafluoroethylene (ETFE), compressed inorganic powders, or combinations thereof. Preferably, the first insulator 7 and the second insulator 8 are selected to optimize the line reactance of the transmission line 1 while also accounting for the size and weight of the entire system.

First Node 9 and Second Node 11

The first node 9 and the second node 11 are devices capable of sending or receiving a signal transmitted on the transmission line 1. Preferably, the transmission line 1 is optimized for the desired signal or power propagation between the first node 9 and the second node 11. In one embodiment, the first node 9, the second node 11, or both are sensitive to the line reactance of the transmission line 1.

In one embodiment, the first node 9 is a control system and the second node 9 is one or more sensors (e.g., thermistor, photodiode, tensiometer, wound coil etc.). For example, in one embodiment, the first node 9 is a computer and the second node 11 is a collection of metal plates of ion-cyclotron-resonance (ICR). In another embodiment, the first node 9 is a first computer and the second node 11 is a second computer. In yet another embodiment, the first node 9 is a power supply source and the second node 11 is an electrically resistive load, such as a motor, computer, light, or television. In yet another embodiment, the first node 9 is a computer and the second node 11 is a servo motor control.

Figures 2A, 2B:
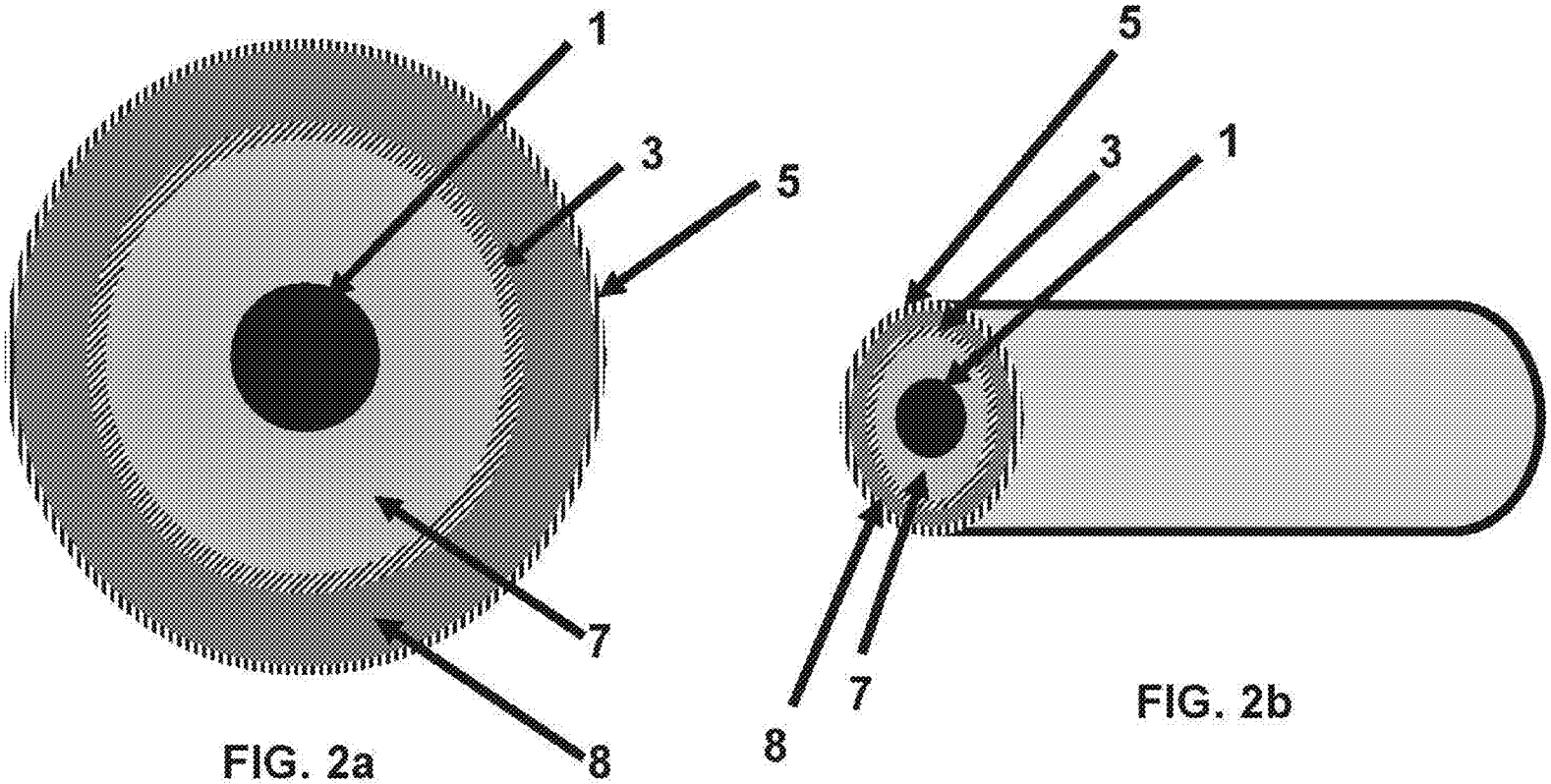
FIG. 2*a* depicts an end view of a preferred embodiment of an electromagnetic wrap having a first floating conductor completely surrounding the length of a transmission line; and a grounding conductor completely surrounding the length of the first floating conductor.
FIG. 2*b* depicts a perspective view of a preferred embodiment of an electromagnetic wrap having a first floating conductor completely surrounding the length of a transmission line; and a grounding conductor completely surrounding the length of a first floating conductor.

FIG. 2*a* and FIG. 2*b*

FIG. 2*a* depicts an end view and FIG. 2*b* depicts a perspective view of a preferred embodiment having a transmission line 1, a first insulator 7, a first floating conductor 3, a second insulator 8, and a grounding conductor 5 each having a cylindrical shape. In this embodiment, the first insulator 7 surrounds the transmission line 1 along its entire length. The first floating conductor 3 surrounds the first insulator 7 along its entire length. The second insulator 8 surrounds the first floating conductor 3 along its entire length. Finally, the grounding conductor 5 surrounds the second insulator 8 along its entire length. Preferably, the transmission line 1 is surrounded by and central to the first insulator 7, the first floating conductor 3, the second insulator 8, and the grounding conductor 5.

Although the first floating conductor 3 is depicted as a solid conductor in FIG. 2*a* and FIG. 2*b*, it may be one or more wires wound around the first insulator 7. Likewise, the grounding conductor 5 may be one or more wires wound around the second insulator 8. Similarly, the transmission line 1 may be a one or more wires running in parallel or wound around an object. Using readily available wires to construct the transmission line 1, first floating conductor 3, grounding conductor 5, or a combination thereof may be preferably, since it may be more cost effective.

Although FIG. 2*a* and FIG. 2*b* depict the transmission line 1, the first floating conductor 3 and the grounding conductor 5 as having similar shapes and dimensions, the transmission line 1, the first floating conductor 3, the grounding conductor 5 or a combination thereof may have unique dimensions (length, width, height) or shapes. For example, it may be preferably to alter the length of the first floating conductor 3, the grounding conductor 5 or both to variably alter the line reactance of the transmission line 1 for optimal efficiency.

FIG. 3 and FIG. 4

Figure 3:
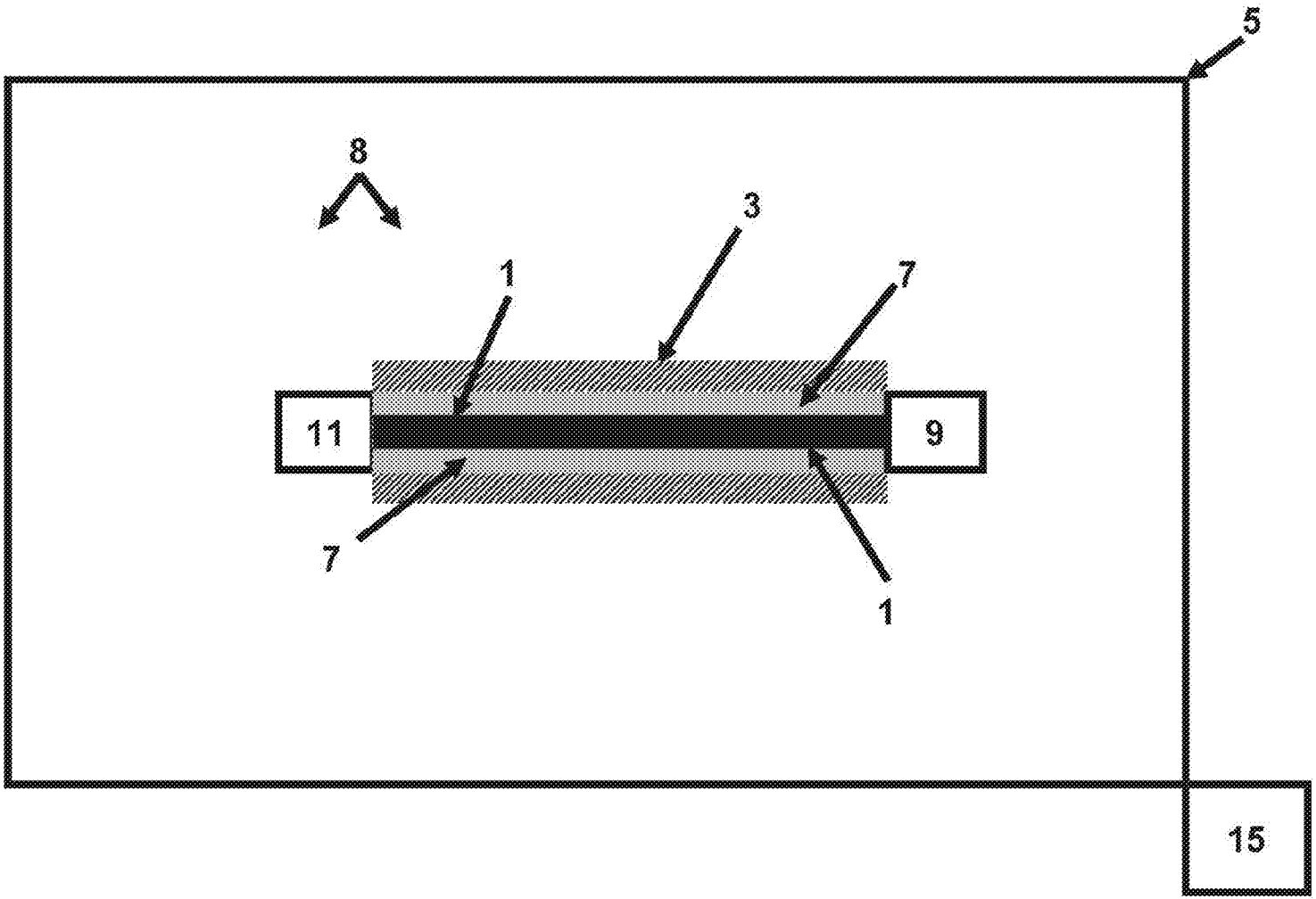
FIG. 3 depicts a longitudinal cross section view of a preferred embodiment of an electromagnetic wrap having a grounding conductor at a distance from the first floating conductor.
Figure 4:
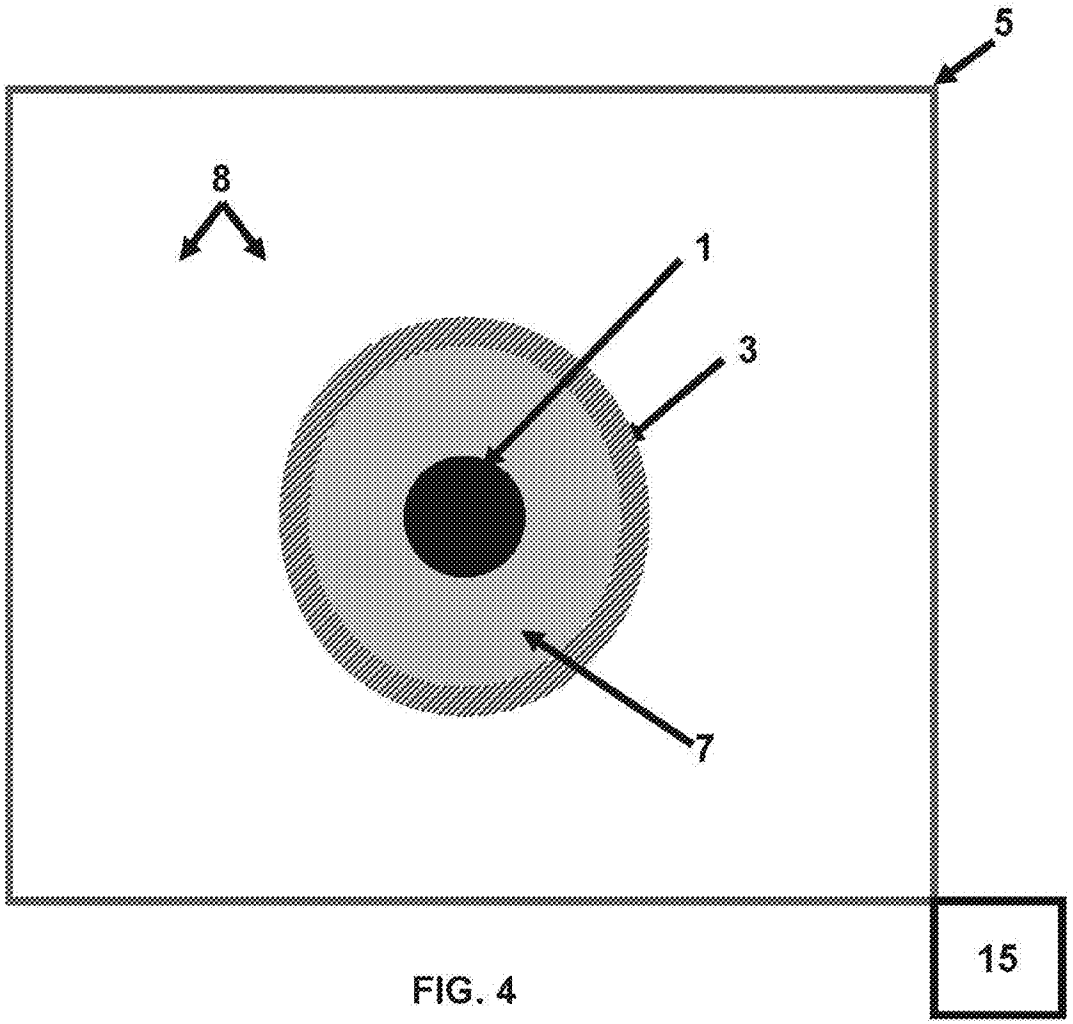
FIG. 4 depicts an end view of a preferred embodiment of an electromagnetic wrap having a grounding conductor at a distance from a first floating conductor.

FIG. 3 depicts a longitudinal cross section view and FIG. 4 depicts an end view of a preferred embodiment having a transmission line 1 at a distance from a grounding conductor 5. A first node 9 and a second node 11 are directly electrically connected to a transmission line 1. The first insulator 7 surrounds the transmission line 1 along its entire length. The first floating conductor 3 surrounds the first insulator 7 along its entire length. The second insulator 8 surrounds the first floating conductor 3 along its entire length.

The grounding conductor 5 completely surrounds the transmission line 1, the first insulator 7, the first floating conductor 3, the second insulator 8. The grounding conductor 5 is electrically connected to earth-ground 15. Preferably, the grounding conductor 5 is one or more electrically conductive elements leadings to earth-ground (e.g., casings, tables, floors, pipes, etc.). Preferably, in this embodiment, the second insulator 8 is air.

FIG. 5

Figure 5:
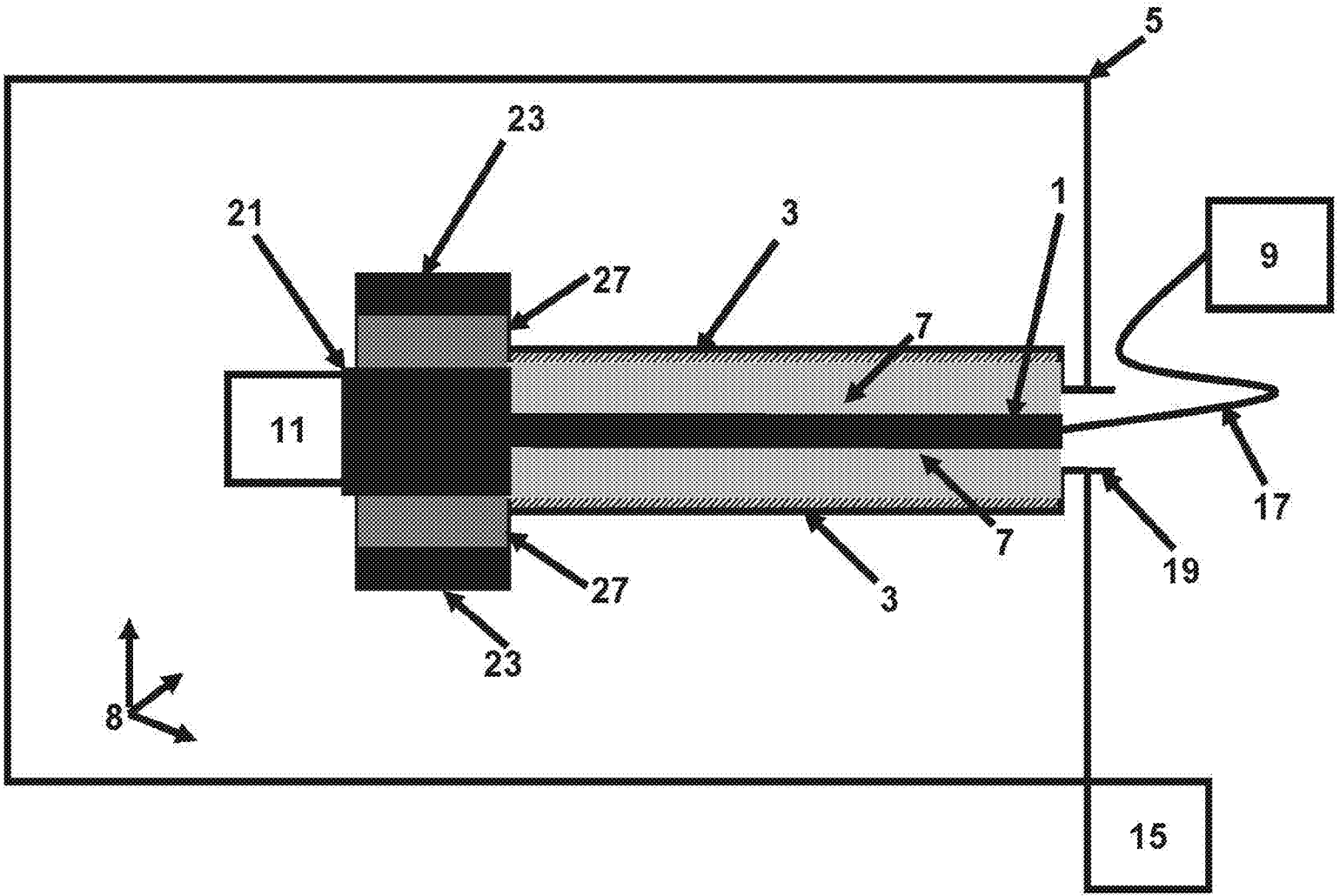
FIG. 5 depicts a longitudinal cross section view of a preferred embodiment of an electromagnetic wrap having a plurality of transmission lines and floating conductors all surrounded by a grounding conductor.

FIG. 5 depicts a longitudinal cross section view of a preferred embodiment having a plurality of transmission lines and floating conductors surrounded by a grounding conductor. In this embodiment, a first transmission line 1, a first floating conductor 3, a first insulator 7, a second insulator 8, a second transmission line 21, a third insulator 27, a second floating conductor 23, and a second node 11 are encased within a grounding conductor 5.

In this embodiment, a first node 9, exterior to the grounding conductor 5, is connected to the first transmission line 1 by one or more external transmission wires 17. An aperture 19 in the grounding conductor 5 allows the one or more external transmission wires 17 to connect to the first transmission line 1 within the interior of the grounding conductor 5. The first transmission line 1 is electrically connected to the second transmission line 21. Finally, the second transmission line 21 is electrically connected to the second node 11.

The first transmission line 1 is completely surrounded by the first floating conductor 3 along the length of the first transmission line 1. A first insulator 7 is positioned between the first transmission line 1 and the first floating conductor 3. The second transmission line 21 is completely surrounded by the second floating conductor 23 along the length of the second transmission line 21. A third insulator 27 is positioned between the second transmission line 21 and the second floating conductor 23.

The first floating conductor 3 and the second first floating conductor 23 are electrically insulated from the grounding conductor 5 by a second insulator 8. Preferably, in this embodiment, the second insulator 8 is air.

In this embodiment, the grounding conductor 5 is preferably a casing for a larger device, which protects the larger device from electrical noise. The grounding conductor 5 is electrically connected to earth-ground 15.

In the alternative, the first node 9 may be positioned inside the grounding conductor 5. In this embodiment, it may be preferably to omit the one or more external transmission wires 17. In yet another alternative, the second node 11 may be positioned outside of the grounding conductor 5. In this embodiment, it may be preferably to include the one or more wires 17 additionally between the second node 11 and the transmission line 1 within the grounding conductor 5.

One or More External Transmission Wires 17

The one or more external transmission wires 17 transfer the signal produced by the first node 9 into the transmission line 1. The one or more wires 17 are electrical conductors, preferably, wires, coaxial cabling, electrically conductive tubes, the embodiment shown in FIG. 1, etc. In a preferred embodiment, the one or more wires 17 are one or more of the embodiment shown in FIG. 2.

Experimentation

Using an embodiment similar to FIG. 5, the capacitive reactance was altered for a system having a line capacitance of about 150 pf. The one or more wires 17 were a single RG-58 coaxial cable having a length of about 3.5 feet connecting the first node 9 to the first transmission line 1. The first transmission line 1 was a 22 gauge enameled wire. The first insulator 7 was a solid ceramic. The first floating conductor 3 was a ⅛ inch copper tube. The first transmission line 1 had a length of 12 feet and the first floating conductor 3 had a length of about 3 feet.

The second transmission line 21 was a ⅛ inch copper tube. The second insulator 27 was ¼ inch fish-spine insulators separating the second transmission line 21 and the second floating conductor 23, therefore using air (vacuum) as an insulator. The second floating conductor 23 was a ⅜ stainless steel tube. The second transmission line 21 and the second floating conductor 23 each had a length of about 8 inches. The grounding conductor 5 was a steel encasing designed to prevent electrical noise from entering or exiting its interior.

By surrounding the first transmission line 1 with the first floating conductor 3 and the second transmission line 21 with the second floating conductor 23 the capacitance of the transmission system (one or more wires 17, first transmission line 1, and second transmission line 21) was lowered to about 90 pf.

FIG. 6

Figure 6:
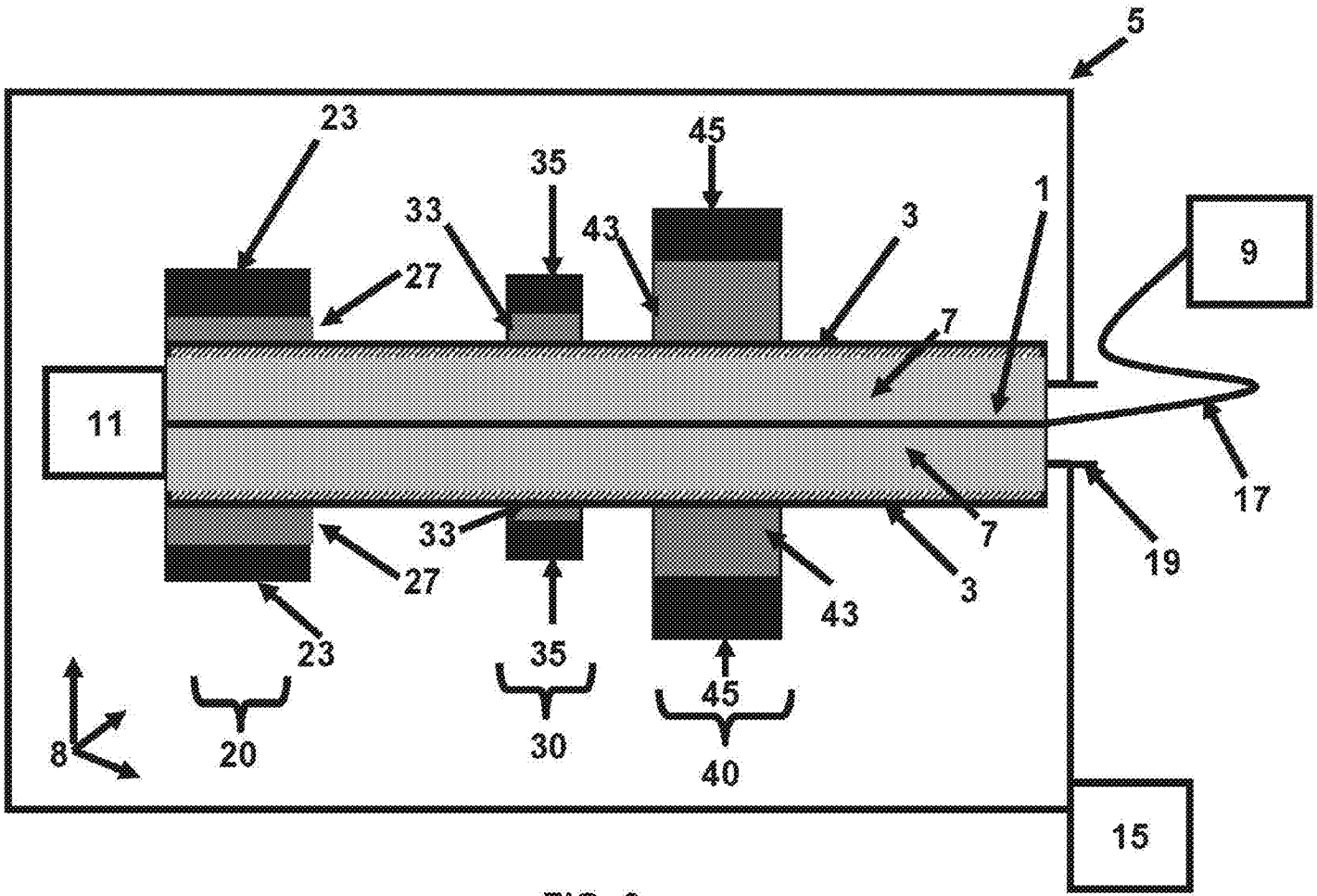
FIG. 6 depicts a longitudinal cross section view of one embodiment of a transmission line having a plurality of electromagnetic wraps.

FIG. 6. depicts a longitudinal cross section view of one embodiment of a transmission line with a plurality of electromagnetic wraps. In this embodiment, a first transmission line 1 and a first floating conductor 3 are separated by a first insulator 7. A first electromagnetic wrap 20, a second electromagnetic wrap 30, and a third electromagnetic wrap 40 each partially surround the first floating conductor 3 at unique positions.

A second insulator 8 electrically insulates the first floating conductor 3, the first electromagnetic wrap 20, the second electromagnetic wrap 30, and the third electromagnetic 40 wrap from the grounding conductor 5. Preferably, the second insulator 8 is air. The grounding conductor 5 is electrically connected to earth-ground 15.

A first node 9, exterior to the grounding conductor 5, is connected to the first transmission line 1 by one or more external transmission wires 17. An aperture 19 in the grounding conductor 5 allows the one or more external transmission wires 17 to connect to the first transmission line 1 within the interior of the grounding conductor 5. The first transmission line 1 is electrically connected the second node 11.

The first electromagnetic wrap 20 has an insulator 27 and a floating conductor 23. The insulator 27 of the first electromagnetic wrap 20 partially surrounds the first floating conductor 3 at a position unique from the second electromagnetic wrap 30 and the third electromagnetic wrap 40. The insulator 27 of the first electromagnetic wrap 20 is then surrounded, preferably fully surrounded, by the floating conductor 23 of the first electromagnetic wrap 20.

The second electromagnetic wrap 30 has an insulator 33 and a floating conductor 35. The insulator 33 of the second electromagnetic wrap 30 partially surrounds the first floating conductor 3 at a position unique from the first electromagnetic wrap 20 and the third electromagnetic wrap 40. The insulator 33 of the second electromagnetic wrap 30 is then surrounded, preferably fully surrounded, by the floating conductor 35 of the second electromagnetic wrap 30.

The third electromagnetic wrap 40 has an insulator 43 and a floating conductor 45. The insulator 43 of the third electromagnetic wrap 40 partially surrounds the first floating conductor 3 at a position unique from the first electromagnetic wrap 20 and the second electromagnetic wrap 30. The insulator 43 of the third electromagnetic wrap 40 is then surrounded, preferably fully surrounded, by the first floating conductor 45 of the third electromagnetic wrap 40.

The size and shape of the electromagnetic wraps (the first electromagnetic wrap 20, the second electromagnetic wrap 30, and the third electromagnetic wrap 40) may be the same or different. By adjusting the various sizes of the electromagnetic wraps, the line reactance of the transmission line 1 can be altered. Thus, the line reactance of the transmission line 1 could be designed to block (filter) or pass desired frequencies along the transmission line 1, whether for signal or power, more efficiently.

In one embodiment, one or more electromagnetic wraps are used in an inline filter design whereby deleterious frequencies traveling through the transmission line 1 are attenuated favoring desired frequencies. This may reduce the cost and size of various filters used in communications, as well as in power systems.

FIG. 7

Figure 7:
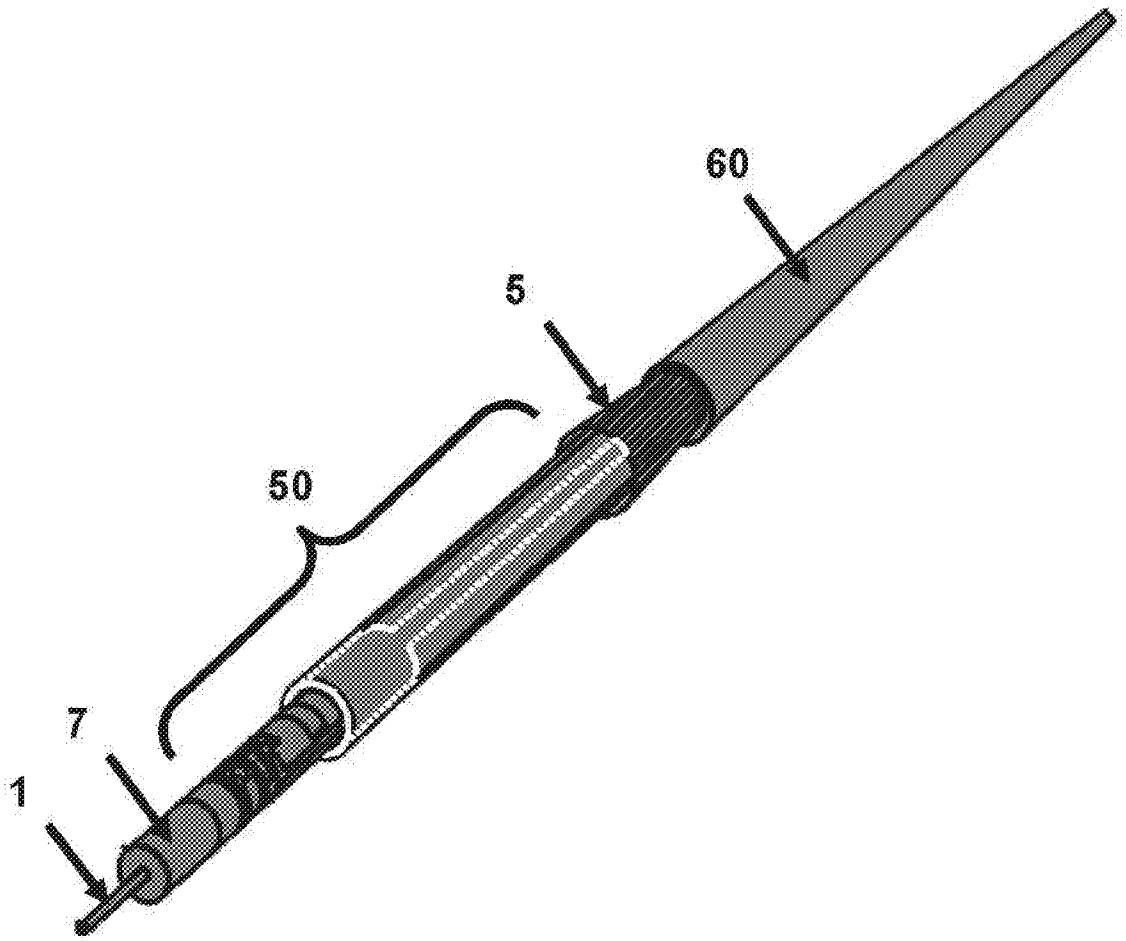
FIG. 7 depicts a perspective view of one embodiment of an electromagnetic wrap wrapped having an elaborate design.

FIG. 7 depicts a perspective view of one embodiment of an electromagnetic wrap wrapped with an elaborate first floating conductor/insulator design. In this embodiment a transmission line 1 is surrounded by a first insulator 7. The first insulator 7 is then surrounded by one or more floating conductor patterns 50. The one or more first floating conductor patterns 50 are surrounded by a grounding conductor 5. Finally the grounding conductor 5 is surrounded by a transmission line protective jacket 60. The grounding conductor 5 is electrically connected to earth-ground (not shown for simplicity) on at least one end of the cable.

The one or more floating conductor patterns 50 finely tune the line reactance of the transmission line 1 by using one or more electromagnetic wraps that are then wrapped around the transmission line 1. One or more floating conductor patterns 50 are preferably printed as conducting films on the first insulator 7 and provide the desired line reactances of the transmission line 1.

The transmission line protective jacket 60 protects the various components from external influences, such as corrosion, electrical conductivity, etc.

Figure 8B:
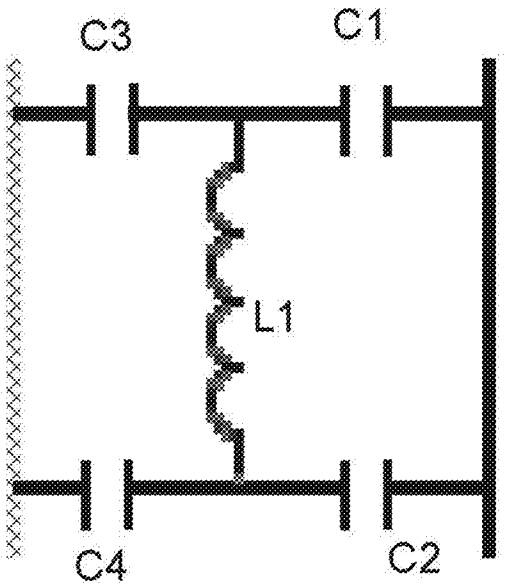
FIG. 8*b* depicts the circuit diagram for the embodiment of an electromagnetic wrap shown in FIG. 8*a*.
Figure 8A:
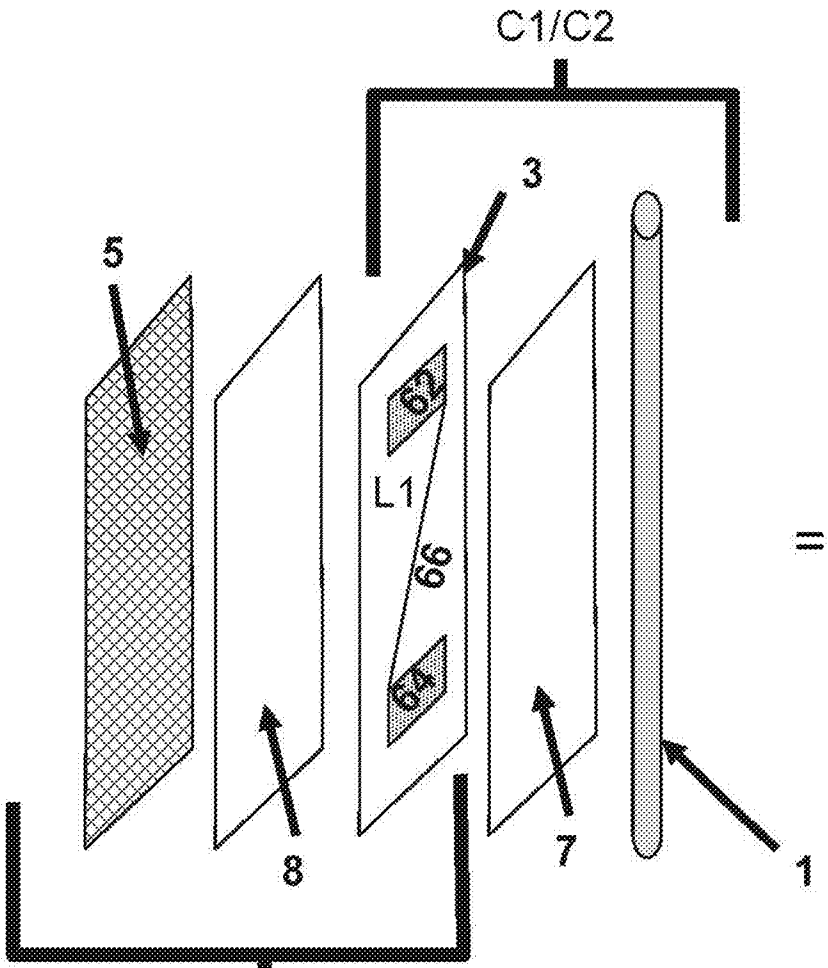
FIG. 8*a* depicts an exploded view of one embodiment of an electromagnetic wrap implementing the circuit diagram shown in FIG. 8*b* having an inductor.

FIG. 8*a* and FIG. 8*b*

FIG. 8*a* depicts one embodiment of an electromagnetic wrap having a design implementing the circuit shown in FIG.

8*b* having an inductor. In this embodiment, the transmission line 1 is surrounded by a first insulator 7. The first insulator 7 is then surrounded by a first floating conductor 3. The first floating conductor 3 is then surrounded by a second insulator 8. The second insulator 8 is then surrounded by a grounding conductor 5, preferably a braided shield electrically connected to earth-ground (not shown for simplicity). Preferably, the grounding conductor 5 is surrounded by a protective jacket 60 (not shown for simplicity), creating the electromagnetic wrap shown in FIG. 7.

In this embodiment, the first floating conductor 3 has a first conductive pattern 62 and a second conductive pattern 64. The first conductive pattern 62 and the second conductive pattern 64 are electrically separated except for a narrow conductive pattern 66. As the first floating conductive pattern 62 is wrapped around the first insulator 7 (and transmission line 1), the first conductive pattern 62 forms a first capacitor C1 (shown in FIG. 8*b*) between the first conductive pattern 62 and the transmission line 1, as shown in FIG. 8*a*.

The first floating conductor 3 is preferably a substrate having the first conductive pattern 62 and the second conductive pattern 64. In the alternative, the first floating conductor 3 may be the first conductive pattern 62 and the second conductive pattern 64, deposited on the first insulator 7.

Likewise, the second conductive pattern 64 forms a second capacitor C2 (shown in FIG. 8*b*) between the second conductive pattern 64 and the transmission line 1, as shown in FIG. 8*a*. The narrow conductive pattern 66, as it is wrapped around the first insulator 7 (and transmission line 1), forms a first inductor (L1) (shown in FIG. 8*b*) connecting the first conductive pattern 62 and the second conductive pattern 64, shown in FIG. 8*a*.

The gap between the first floating conductor 3 and the grounding conductor 5 produces a second set of capacitors, as shown in FIG. 8*a* and FIG. 8*b*. The first conductive pattern 62 forms a third capacitor C3 (shown in FIG. 8*b*) between the first conductive pattern 62 and the grounding conductor 5, as shown in FIG. 8*a*. Likewise, the second conductive pattern 64 forms a fourth capacitor C4 (shown in FIG. 8*b*) between the second conductive pattern 64 and the grounding conductor 5, as shown in FIG. 8*a*.

Figure 9B:
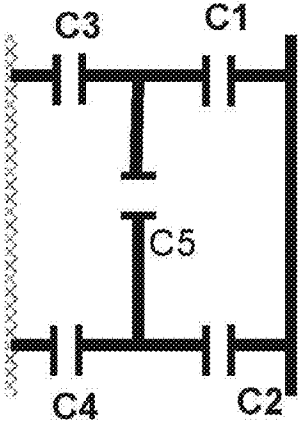
FIG. 9*b* depicts the circuit diagram for the embodiment of an electromagnetic wrap shown in FIG. 9*a*.
Figure 9A:
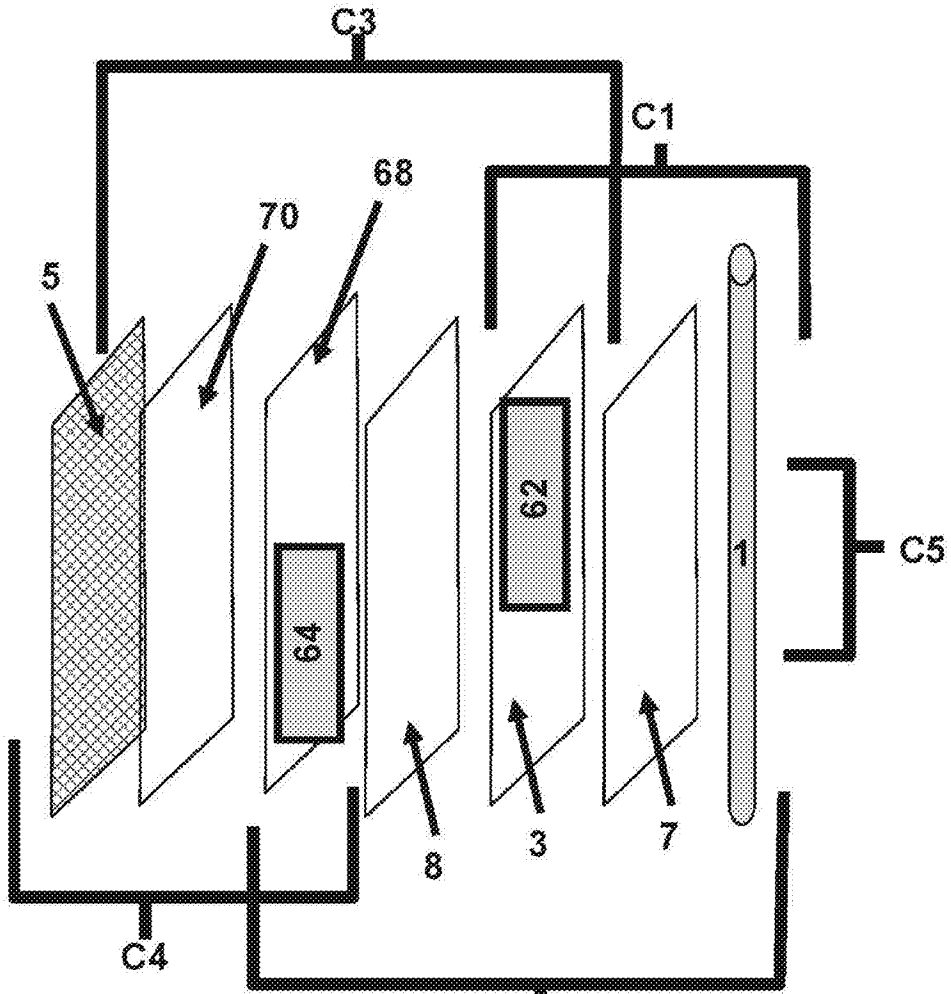
FIG. 9*a* depicts an exploded view of one embodiment of an electromagnetic wrap implementing the circuit diagram shown in FIG. 9*b* having capacitors connected in series and in parallel.

FIG. 9*a* and FIG. 9*b*

FIG. 9*a* depicts one embodiment of an electromagnetic wrap having a design implementing the circuit shown in FIG. 9*b* having capacitors connected in series and in parallel. In this embodiment, the transmission line 1 is surrounded by a first insulator 7. The first insulator 7 is then surrounded by a first floating conductor 3 having a first conductive pattern 62. The first floating conductor 3 is then surrounded by a second insulator 8. The second insulator 8 is then surrounded by a second floating conductor 68 having a second conductive pattern 64. The second floating conductor 68 is then surrounded by a third insulator 70. The third insulator 70 is then surrounded by a grounding conductor 5. Preferably, the grounding conductor 5 is surrounded by a protective jacket 60 (not shown for simplicity), creating the electromagnetic wrap shown in FIG. 7.

The first conductive pattern 62 of the first floating conductor 3 and the second conductive pattern 64 of the second floating conductor 68 partially overlap each other between the transmission line 1 and the grounding conductor 5. This partial overlap generates a parallel connecting capacitor (C5 in FIG. 9*b*).

In the alternative, the first conductive pattern 62 of the first floating conductor 3 and the second conductive pattern 64 completely overlap creating a series connected capacitor. In yet another alternate embodiment, the first conductive pattern 62 of the first floating conductor 3 and the second conductive pattern 64 do not overlap at all creating two separate capacitor paths, such as the circuit diagram shown in FIG. 9*b*, without the interconnected capacitor (C5).

The first floating conductor 3 is preferably a substrate having the first conductive pattern 62. In the alternative, the first floating conductor 3 is the first conductive pattern 62 is deposited onto the first insulator 7.

Likewise, the second floating conductor 68 is preferably a substrate having the second conductive pattern 64. In the alternative, the second floating conductor 68 is the second conductive pattern 64 deposited onto the second insulator 8.

The first conductive pattern 62 forms a first capacitor C1 (shown in FIG. 9*b*) between the first conductive pattern 62 and the transmission line 1, as shown in FIG. 9*a*. Likewise, the second conductive pattern 64 forms a second capacitor C2 (shown in FIG. 9*b*) between the second conductive pattern 64 and the transmission line 1 (passing through the first insulator 7, the first floating conductor 3 and the second insulator 8), as shown in FIG. 9*a*.

The first conductive pattern 62 also forms a third capacitor C3 (shown in FIG. 9*b*) between the first conductive pattern 62 and the grounding conductor 5 (passing through the second insulator 8, the second floating conductor 68 and the third insulator 70), as shown in FIG. 9*a*. Likewise, the second conductive pattern 64 forms a fourth capacitor C4 (shown in FIG. 9*b*) between the second conductive pattern 64 and the grounding conductor 1, as shown in FIG. 9*a*.

The first conductive pattern 62 of the first floating conductor 3 and the second conductive pattern 64 of the second floating conductor 68 also form a fifth capacitor (C5) (shown in FIG. 9*b*) coupling the first capacitor (C1) and the third capacitor (C3) to the second capacitor (C2) and the forth capacitor (C4), as shown in FIG. 9*b*.

FIG. 10*a*

Figure 10B:
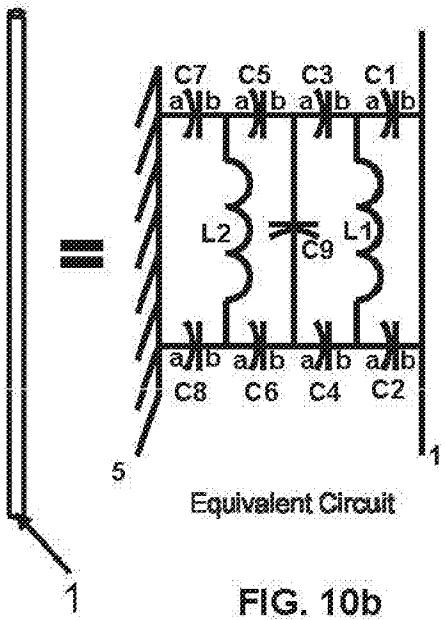
FIG. 10*b* depicts the schematic for the circuit created by the embodiment of an electromagnetic wrap shown in FIG. 10*a*.
Figure 10A:
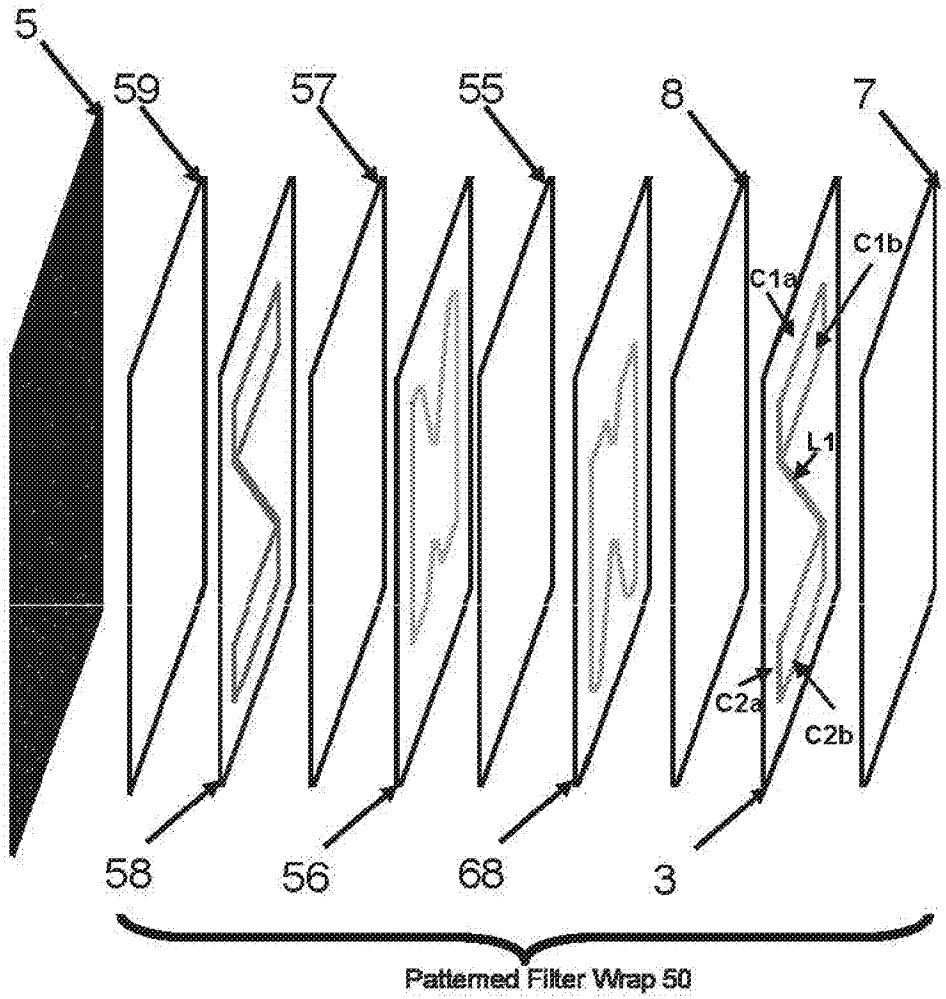
FIG. 10*a* depicts an exploded view of one embodiment of an electromagnetic wrap implementing the circuit diagram shown in FIG. 10*b* having both inductive and capacitive components.

FIG. 10*a* depicts an exploded view of one embodiment of an electromagnetic wrap preferably wrapped as shown in FIG. 7. In this embodiment, a transmission line 1 is surrounded by the following in the following order: a first insulator 7, a first floating conductor 3 (e.g., conducting pattern embedded in a non-conducting film), a second insulator 8, a second floating conductor 68, a third insulator 55, a third floating conductor 56, a fourth insulator 57, a fourth floating conductor 58, a fifth insulator 59, and a grounding conductor 5, preferably a braided shield electrically connected to earth-ground (not shown for simplicity). Each layer is independently wrapped around the transmission line 1 forming a design as shown in FIG. 7. Preferably, a transmission line protective jacket (not shown for simplicity) is wrapped around the grounding conductor 5 in order to hold together and protect the electromagnetic wrap.

The floating conductors (first floating conductor 3, the second floating conductor 68, the third floating conductor 56, and the fourth floating conductor 58), each have conductors which alter the line reactance of the transmission line 1. The floating conductors are each represented as a conducting pattern embedded in a non-conducting film in FIG. 10*a*, but they could also be solid conductors in other embodiments, which would alter the circuit produced in FIG. 10*b*. In yet another alternative embodiment, one or more of the floating conductors are embedded in one or more of the insulators (first insulator 7, second insulator 8, third insulator 55, fourth insulator 57, fifth insulator 59).

The first floating conductor 3 and the fourth floating conductor 58 each have a first conductive pattern and a second conductive pattern connected by a narrow conductor (creating an inductor as described in FIG. 8*a* and FIG. 8*b*). The second floating conductor 68 and the third floating conductor 56 each have a conductive pattern and provide interlayer capacitances (creating a parallel running capacitor as described in FIG. 9*a* and FIG. 9*b*) to complete the filter circuit illustrated in FIG. 10*b*.

FIG. 10*b*

FIG. 10*b* depicts the schematic of the circuit created by the embodiment of an electromagnetic wrap shown in FIG. 10*a*. FIG. 10*b* is a schematic of a low pass filter circuit implemented in the electromagnetic wrap concept of FIG. 10*a*. to prevent high frequency modes of energy transfer that could otherwise be stimulated to flow and cause surging of large voltages and/or currents in connected circuits within or at one or both ends of the transmission line 1. The electromagnetic wrap in FIG. 10*a* is but one example of a myriad of filter circuits possible with this technique once the concept is fully understood.

FIG. 11

Figure 11:
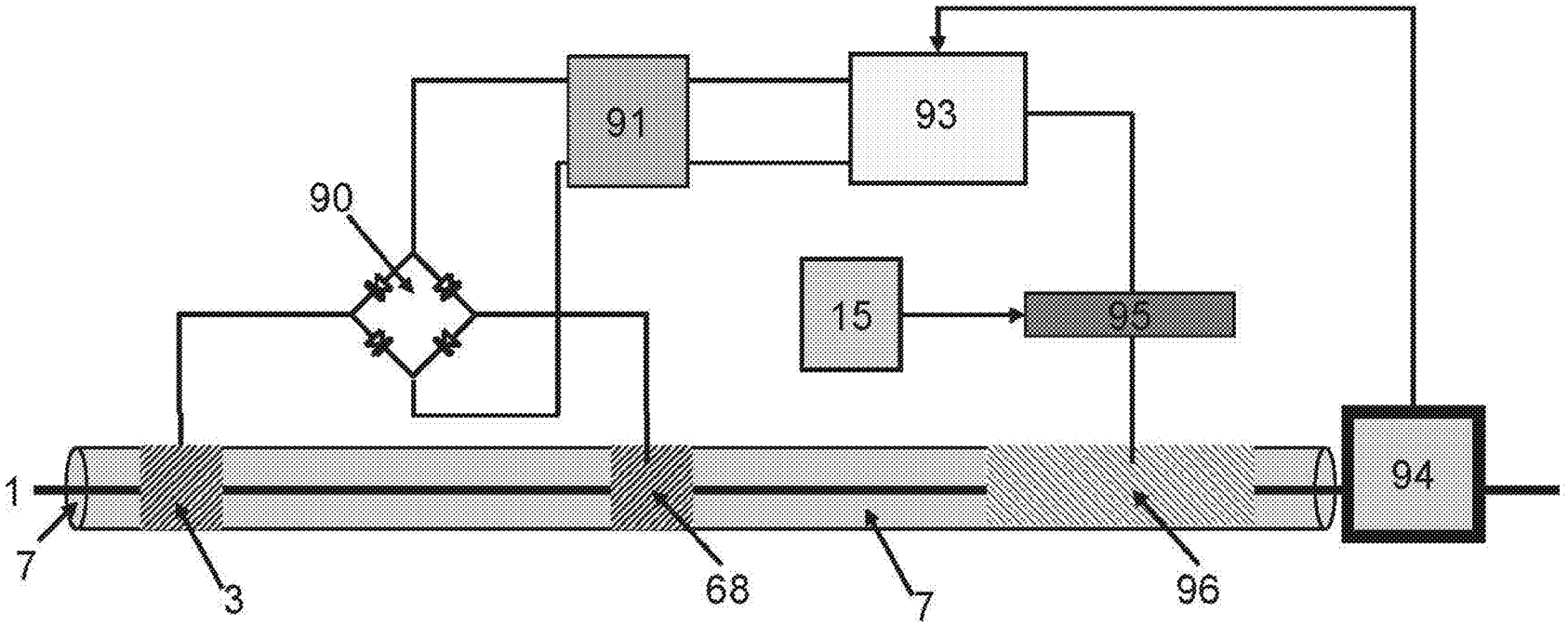
FIG. 11 depicts one embodiment of an electromagnetic wrap employing active components to dynamically change the line reactance of a transmission line.

FIG. 11 depicts one embodiment of an electromagnetic wrap employing active components to dynamically change the line reactance of a transmission line. In this embodiment, a transmission line 1 is surrounded by a first insulator 7. The first insulator 7 is partially surrounded by a first floating conductor 3 and a second floating conductor 68. Both the first floating conductor 3 and the second floating conductor 68 are connected to a diode bridge 90. The diode bridge 90 is connected to a small battery or capacitor 91. The small battery or capacitor 91 is connected to a control system 93. The control system 93 is connected to a switch 95. The switch 95 is connected to earth-ground 15 and a third floating conductor 96. The control system 93 is also connected to a reflectometer 94. The reflectometer 94 is connected to the transmission line 1.

The embodiment in FIG. 11 couples a transmission line 1 to a diode bridge 90 using capacitive coupling. The diode bridge 90 powers a small battery or capacitor 91. The small battery or capacitor 91 is connected to and powers a control system 93, preferably a microcontroller. This circuit derives power by sampling the signal through capacitive coupling of a first floating conductor 3 and a second floating conductor 68 from the transmission line 1.

In the alternative power for the control system 93 may be obtained using other parasitic methods including inductive coupling through from the current flowing in the transmission line 1. This parasitic method also uses the diode bridge 90, which rectifies the current to direct current and stores power for the circuit in the small battery or capacitor 91. In the alternative, other power sources may be used, such as an external battery, or a simple ac/dc conversion device, such as a wall-wart.

The Control System 93

The control system 93 is connected to the reflectometer 94. The reflectometer 94 monitors the flow and level of power in each direction of the transmission line 1 and produces a signal to the control system 93. The control system 93, using the input from the reflectometer 94, controls the switch 95, which electrically connects the third floating conductor 96 to earth ground 15 or electrically floats the third floating conductor 96.

In a preferred embodiment, the control system 93 is a microcontroller or an ASIC (Application Specific Integrated Circuit). Preferably, the control system 93 comprises an analog-to-digital converter which continuously monitors the voltage, the current (converted to a voltage signal), or a combination thereof of the transmission line 1 for reflections, resonations, surges, standing wave ratio, combinations thereof, etc. As known in the art, there are various methods of converting current into a voltage, such as reading the voltage of a known resistor or using a voltage-to-current op-amp design.

In the preferred embodiment, the control system 93 monitors the voltage, current or a combination thereof for reflections, resonations, surges, standing wave ratio, combinations thereof, etc. If for example a resonation is detected, the control system 93 may electrically float the third floating conductor 96 which change the electrical characteristics of the transmissions line 1 to attenuate the resonation. Likewise, if the standing wave ratio is undesirable, the control system may electrically ground or float the third floating conductor 96 to selectively alter the line reactance of the transmission line 1 thereby altering the standing wave ratio to desired levels.

In one alternate embodiment, the control system 93 comprise a display (e.g., a liquid crystal display), which displays to the user information such as voltage, current or a combination thereof (e.g., voltage/current waveforms, absolute, average, rms values, etc.). Preferably, the control system 93 displays one or more alerts to the user of the presence of undesirable resonance, standing wave ratio's etc., as the system alters the line reactance of the transmission line 1 using one or more of the above described electromagnetic wraps to attenuate such undesirable resonance, standing wave ratio's etc.

In a preferred embodiment, the reflectometer 94 is comprises a conductor positioned close enough to the transmission line 1 such that energy passing through the transmission line 1 is coupled to an output of the reflectometer 94, which is connected to the control system 93 for analysis.

The Switch 95

The switch 95 is preferably optically coupled to the control system 93. The control system 93 uses the switch 95 to electrically ground or electrically float the third floating conductor 96 to change the reactive properties of the transmission line 1. In a preferred embodiment, the switch 95 is a switched electrically controlled by an optical receiver. The optical receiver is optically coupled to an electrical optical transistor electrically connected to the control system 93. This embodiment is preferable to avoid any electrical noise or surges from passing from the third floating conductor 96 into the control system 93. In the alternative, the reflectormeter 94 may also be similarly optically coupled to the control system 93.

The Third Floating Conductor 96

The third floating conductor 96 contains one or more conductive patterns, such as shown in FIG. 8*a*, FIG. 9*a*, and FIG. 10*a*. Preferably, the third floating conductor 96 is designed to minimize the standing wave ratio of the power being transferred through the transmission line 1 as it is electrically connected to earth ground by the switch 95 controlled by the control system 93.

In one embodiment, the floating conductor 96 is a conductor wrapped completely around and running partially along the length of the transmission line 1. In this embodiment, the control system 93 grounds or floats the third floating conductor 96 optimizing the line reactance of the transmission line 1 depending on the conditions of the transmission line 1 (e.g. reflections, load, standing wave ratio, etc.).

In another embodiment, the floating conductor 96 is a conductor wrapped comprising one or more of the electromagnetic wrap design creating the inductor design shown in FIG. 8*a*, the electromagnetic wrap design creating the capacitor designs shown in FIG. 9*a*, or a combination thereof. In this embodiment, the control system 93 grounds or floats the third floating conductor 96 optimizing the line reactance of the transmission line 1 depending on the conditions of the transmission line 1 (e.g., reflections, load, standing wave ratio, etc.).

Preferably, a plurality of the third floating conductor 96 (either having similar designs or different designs) are positioned along the transmission line 1 in order to optimize the line reactance of the transmission line 1 depending on the conditions of the transmission line 1 (e.g., reflections, load, standing wave ratio, etc.).

It is to be understood that the above-described arrangements are only illustrative of the application of the principles of an electromagnetic wrap for dealing with line reactance. Numerous modifications and alternative arrangements may be devised by those skilled in the art without departing from the spirit and scope of an electromagnetic wrap and the appended claims are intended to cover such modifications and arrangements.

All publications and patent documents cited in this application are incorporated by reference in their entirety for all purposes to the same extent as if each individual publication or patent document were so individually denoted.

Any element in a claim that does not explicitly state "means for" performing a specified function, or "step for" performing a specific function, is not to be interpreted as a "means" or "step" clause as specified in 35 U.S.C.§112, ¶ 6. In particular, the use of "step of" in the claims herein is not intended to invoke the provisions of 35 U.S.C.§11238, ¶ 6.

The invention claimed is:

1. An electromagnetic wrap for optimizing the line reactance of a transmission line comprising:

a first node;

a second node;

a transmission line having a length;

said first node and said second node electrically connected to said transmission line at opposite ends;

a first floating conductor having a length;

said first floating conductor and said transmission line separated by a first insulator;

a grounding conductor electrically connected to earth-ground;

said grounding conductor and said first floating conductor separated by a second insulator; and said first floating conductor at least partially positioned between said transmission line and said grounding conductor.

2. The electromagnetic wrap of claim 1 whereby said first floating conductor surrounds said transmission line entirely along said length of said transmission line.

3. The electromagnetic wrap of claim 1 whereby said grounding conductor surrounds said first floating conductor entirely along said length of said first floating conductor.

4. The electromagnetic wrap of claim 1 whereby:

said grounding conductor surrounds said first floating conductor entirely along said length of said grounding conductor; and said first floating conductor surrounds said transmission line entirely along said length of said first floating conductor.

5. The electromagnetic wrap of claim 1 further comprising:

a. one or more floating conductor and insulator pairs positioned between said second insulator and said grounding conductor;

b. a floating conductor from said one or more floating conductor and insulator pairs positioned adjacent to said second insulator; and c. an insulator from said one or more floating conductor and insulator pairs positioned adjacent to said grounding conductor.

6. The electromagnetic wrap of claim 1 whereby said first floating conductor comprises:

a. a first conductive pattern;

b. a second conductive pattern; and c. a narrow conductive path connecting said first conductive pattern and said second conductive pattern.

7. The electromagnetic wrap of claim 6 whereby:

a. said first floating conductor comprises a substrate;

b. said first conductive pattern is a conductive layer deposited directly onto said substrate;

c. said second conductive pattern is a conductive layer deposited directly onto said substrate; and d. said narrow conductive path is a conductive layer deposited directly onto said substrate.

8. The electromagnetic wrap of claim 6 whereby:

a. said first conductive pattern is a conductive layer deposited directly onto said first insulator;

b. said second conductive pattern is a conductive layer deposited directly onto said first insulator; and c. said narrow conductive path is a conductive layer deposited directly onto said first insulator.

9. The electromagnetic wrap of claim 1 further comprising:

a. a second floating conductor at least partially positioned between said second insulator and said grounding conductor;

b. a third insulator at least partially positioned between said second floating conductor and said grounding conductor;

c. said first floating conductor comprising a first conductive pattern;

d. said second floating conductor comprising a second conductive pattern; and e. said first conductive pattern and said second conductive pattern partially overlapping each other.

10. The electromagnetic wrap of claim 9 whereby:

a. said first floating conductor comprising said first conductive pattern is deposited directly onto said first insulator; and b. said second floating conductor comprising said second conductive pattern is deposited directly onto said second insulator.

11. The electromagnetic wrap of claim 1 further comprising:

a. a second floating conductor at least partially positioned between said second insulator and said grounding conductor;

b. a third insulator at least partially positioned between said second floating conductor and said grounding conductor;

c. a third floating conductor at least partially positioned between said third insulator and said grounding conductor;

d. a fourth insulator at least partially positioned between said third floating conductor and said grounding conductor;

e. a fourth floating conductor at least partially positioned between said third insulator and said grounding conductor;

f. a fifth insulator at least partially positioned between said fourth floating conductor and said grounding conductor;

g. said first floating conductor comprising:

i. a first conductive pattern;

ii. a second conductive pattern; and iii. a narrow conductive path connecting said first conductive pattern and said second conductive pattern;

h. said second floating conductor comprising a conductive pattern;

i. said third floating conductor comprising a conductive pattern;

j. said conductive pattern of said second floating conductor and said conductive pattern of said third floating conductor partially overlapping each other between said transmission line and said grounding conductor; and k. said fourth floating conductor comprising:

i. a first conductive pattern;

ii. a second conductive pattern; and iii. a narrow conductive path connecting said first conductive pattern and said second conductive pattern.

12. The electromagnetic wrap of claim 11 whereby:

a. said first floating conductor comprising said first conductive pattern, said second conductive pattern and said narrow conductive path is deposited directly onto said first insulator;

b. said second floating conductor comprising said conductive pattern is deposited directly onto said second insulator;

c. said third floating conductor comprising said conductive pattern is deposited directly onto said third insulator; and d. said fourth floating conductor comprising said first conductive pattern, said second conductive pattern and said narrow conductive path is deposited directly onto said fourth insulator.

13. The electromagnetic wrap of claim 11 further comprising:

a. a control system;

b. a reflectometer connected to said transmission line and said control system;

c. a switch controlled by said control system; and d. said switch having a first position connecting said first floating conductor to earth-ground and a second position electrically floating said first floating conductor.

14. The electromagnetic wrap of claim 1 further comprising:

a. a control system;

b. a reflectometer connected to said transmission line and said control system;

c. a switch controlled by said control system; and d. said switch having a first position connecting said first floating conductor to earth-ground and a second position electrically floating said first floating conductor.

15. The electromagnetic wrap of claim 14 whereby said first floating conductor is deposited directly onto said first insulator.

16. A method of altering the reactance of a transmission line comprising:

a. providing the electromagnetic wrap of claim 1;

b. detecting the voltage, current, or a combination thereof traveling through a transmission line; and c. electrically grounding and electrically floating said floating layer based upon said detected voltage, current, or a combination thereof.

* * * * *